US005268988A

United States Patent [19]

Miyamoto et al.

[11] Patent Number: 5,268,988

[45] Date of Patent: Dec. 7, 1993

[54] ELECTRIC HAIR TREATMENT APPARATUS HAVING HEATED AIR DELIVERY ARM ROTATABLE IN CONICAL PATH ABOUT THE HAIR BEING TREATED

[75] Inventors: Kenji Miyamoto; Yuji Kakuya; Masaharu Shindo, all of Osaka, Japan

[73] Assignee: Takara Belmont Kabushiki Kaisha, Osaka, Japan

[21] Appl. No.: 790,215

[22] Filed: Nov. 8, 1991

[30] Foreign Application Priority Data

Oct. 9, 1991 [JP] Japan ..... 3-82076[U]

[51] Int. Cl.[5] ..... H05B 1/02; A45D 20/08; F24H 3/04

[52] U.S. Cl. ..... 392/380; 34/99; 34/243 R; 132/212; 219/222; 392/360; 392/366

[58] Field of Search ..... 392/366, 379-385, 392/360; 219/222-226; 34/96-101, 243 R, 3; 132/212, 271

[56] References Cited

U.S. PATENT DOCUMENTS 4,691,451 8/1987 Giorgis .
4,910,382 3/1990 Kakuya et al. .

FOREIGN PATENT DOCUMENTS 0093824 6/1982 European Pat. Off. .
476680 5/1929 Fed. Rep. of Germany ..... 34/99
2644045 9/1990 France ..... 392/380
396845 8/1933 United Kingdom ..... 34/99

*Primary Examiner*—Anthony Bartis
*Attorney, Agent, or Firm*—Lackenbach, Siegel, Marzullo, Aronson & Greenspan

[57] ABSTRACT

A hair treatment apparatus includes a rotary arm having an air flow passage, an electric fan for blowing air through the passage to an outlet for impingement onto the hair being treated and an electric heater installed in the passage for heating the air. The rotary arm is rotatably attached at a tiltable angle to an obliquely downwardly facing body cover supported on a support rod and housing an electric motor driven drive mechanism for reciprocally rotating the arm in a path defining a conical surface about the body cover. The tilted angle of the arm is adjustable to change the apex angle of the conical surface described by the arm during rotation. The rotary drive mechanism can slip should the arm be blocked by an external force. A photo sensor position detecting arrangement controls the limits of the reciprocal rotation of the rotary arm.

5 Claims, 11 Drawing Sheets

ELECTRIC HAIR TREATMENT APPARATUS HAVING HEATED AIR DELIVERY ARM ROTATABLE IN CONICAL PATH ABOUT THE HAIR BEING TREATED

BACKGROUND OF THE INVENTION

1. Field of the Invention

The present invention relates to a hair treatment apparatus used for performing drying, dyeing and permanent-waving of hair by blowing warm or hot air onto the hair.

2. Description of the Prior Art

Among conventional hair treatment apparatuses for blowing warm and hot air are a hood type hair treatment apparatus disposed over the head which blows and disturbs hot air in a space surrounding the head by a heater and fan, and a hand dryer which is held by hand and blows hot air to a desired portion of the head.

Another type of hair treatment apparatus already available has one or more infrared heaters directed toward the hair to treat it by the radiation of heat.

The hood type hair treatment apparatus has a drawback of being unable to accommodate the whole hair in the hood when it comes to treat long hair, which is now in fashion. Another disadvantage is that the condition of the hair being dried and disturbed cannot be seen unless the hood is removed. That is, this type of hair treatment apparatus does not allow the hair to be touched and worked upon while being dried.

With the hair treatment apparatus that radiates infrared rays, a blower mounted therein blows hot air only to a certain area not covering the entire area of the head, so that uniform drying often cannot be achieved. Since the area of the head to which the infrared rays are radiated and to which hot air is blown is not changed, not only are the drying and hair treatment not performed evenly but the area may become overheated.

SUMMARY OF THE INVENTION

This invention is intended to eliminate the drawbacks of the above-mentioned conventional hair treatment apparatuses and makes it possible to dry hair uniformly in a short time without disturbing a hair style formed or without requiring the all-time attendance of an operator.

The invention enables hot air to be blown evenly over the entire hair according to the position of the head and to the expanse of the hair being treated, so that not only can long hair and nape hair be dried and treated but an operator can touch the hair with hand to check the drying condition, without a person being treated feeling uncomfortable due to partial overheating or feeling cramped due to the enclosing hood.

Furthermore, it is another object of the invention to provide a means to stop the rotation of a rotary arm that rotates describing a conical surface when it is blocked by the shoulder of a person being treated or by a part of the operator's body, in order to protect them against excessive pressure and resulting pain or prevent the operator from losing his or her balance. It is still another object of the invention to provide a means for changing the mounting angle of the rotating arm, which consists of a rack, a pinion and a fan gear with the pinion so disposed as to be able to be brought into or out of engagement with the rack and the fan gear, so that the angle adjustment can be made easily and the adjusted angle held firmly.

To achieve the above objective, the hair treatment apparatus of this invention comprises: an air blowing means for blowing air toward an opening; a rotary arm having a heater installed in an air blowing passage leading from the air blowing means to the opening; a rotating means using a motor to rotate the rotary arm in a conical surface about a body cover; and a tilting means for the rotating means to make the body cover tiltable with respect to a fixed member such as a support arm.

The hair treatment apparatus should preferably be provided with a mounting angle changing means installed in the rotating means which changes the apex angle of the conical surface described by the rotary arm as it rotates. It is further preferable that the apparatus have a rotating position detecting means installed in the rotating means which consists of a disk and a photosensor to detect the reference position and the rotation limit position of the rotary arm. Furthermore, the amounting angle changing means to change the apex angle of the conical surface described by the rotary arm consists of: a rack gear secured to the rotating means; a fan-shaped gear secured to the rotary arm; and a pinion gear rotatably supported on the rotating means in such a way that the pinion gear is axially slidable to be brought into or out of engagement with the rack gear and the fan-shaped gear.

In the hair treatment apparatus of this invention, the rotary arm with an opening for blowing hot air moves in a conical surface, so that the hot air is blown in a wide area, ranging from the top of the forehead of a person being treated to the lower part of the rear head. This ensures that the hair drying and other hair treatment are performed uniformly over the entire hair. This also prevents the hot air from concentrating on one part of the head so that the person will not feel excess heat.

The space surrounding the hair is open and so one can touch the hair at any time. Further, since the rotary arm can be moved to change the apex angle of the conical surface described by the rotary arm, by using the tilting means, the distance from the hot air outlet of the rotary arm to the hair can be kept uniform if the head position changes as when the person being treated inclines her head forward or backward. Therefore the hot air can be blown to the hair uniformly.

In treating a bulging hair style, the diameter of the bottom of the conical surface described by the rotary arm is changed by the mounting angle changing means to make uniform the distance from the hot air outlet of the rotary arm to the hair, thereby blowing hot air uniformly over the entire hair. Further, since the mounting angle changing means—which consists of a rack gear, a fan-shaped gear and a pinion gear—has the pinion gear arranged in such a way as to be brought into and out of engagement with the rack gear and the fan-shaped gear, the apex angle of the rotary arm can be easily adjusted and firmly held to a desired angle.

Moreover, when during the rotation the rotary arm comes into contact with a part of the body of a person being treated or an operator or hits an object and is thus loaded with an abnormal force, the slip means in the rotating means slips to halt the rotary arm. Since the rotary arm reciprocates in a certain range of angle, the lead wires are prevented from being twisted. Furthermore, when the timer's time is up or the stop operation is done, the rotary arm is made to stop at a predetermined reference position.

DETAILED DESCRIPTION OF PREFERRED EMBODIMENT

Figure 1:
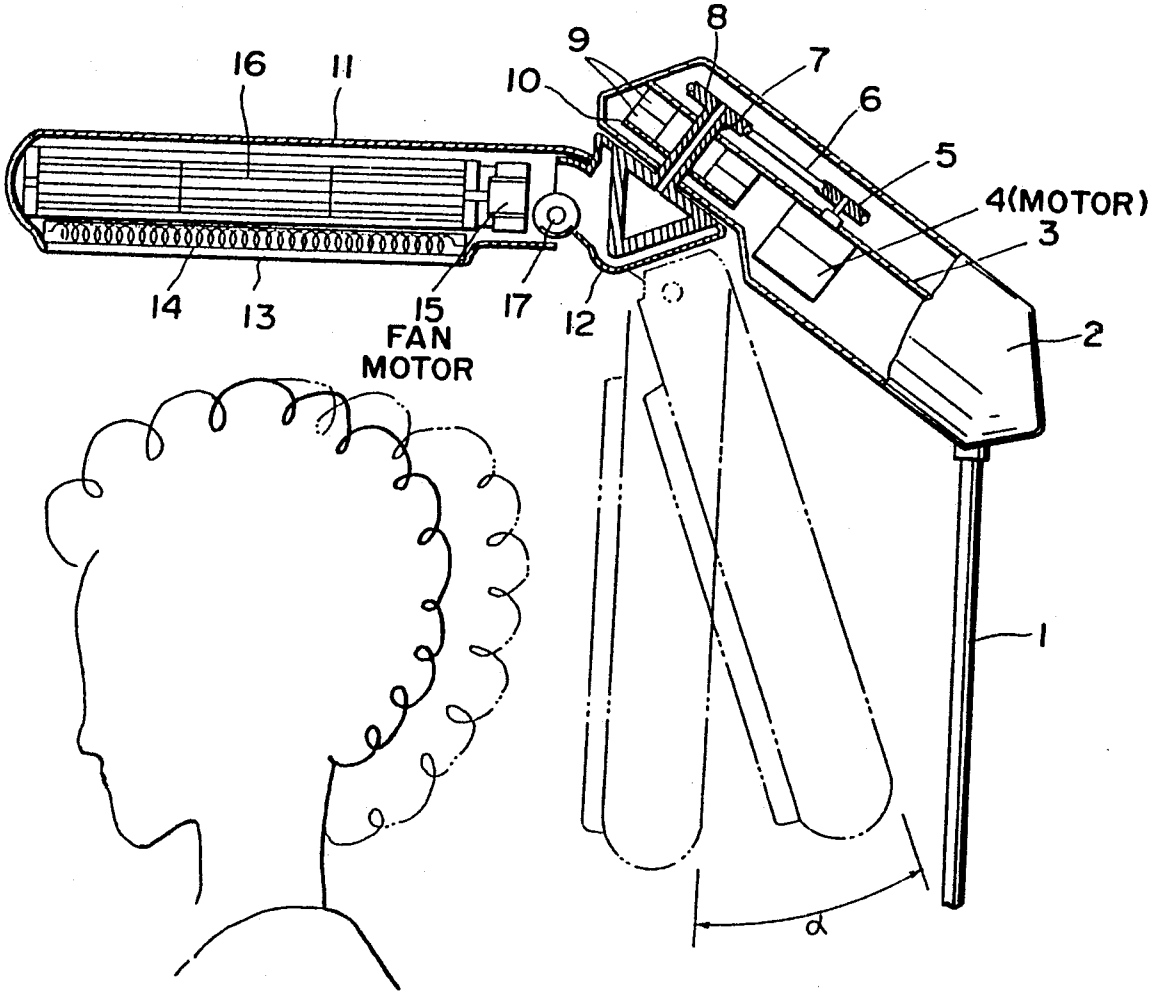
FIG. 1 is a cross section of one embodiment of the invention, showing a rotary arm mounting angle changing means.
Figure 2:
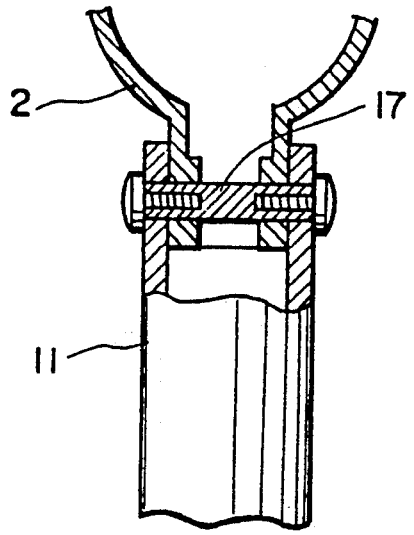
FIG. 2 is a cross section of a mounting portion of a rotating arm of FIG. 1.

One embodiment of the present invention will be described by referring to FIGS. 1 and 2.

Reference numeral 1 signifies a support rod erected on a base installed on the floor. A body cover 2 secured to the upper end of the support rod 1 contains a printed circuit card 3 on which a motor 4 is mounted. A belt 6 attached to a pulley 5 of the motor 4 is wound on a pulley 8 of a rotating shaft 7 rotatably supported on the printed circuit card 3. The rotating shaft 7 is driven by the motor 4.

A rotary feeder 9 mounted on the rotating shaft 7 has its fixed side supported on the printed circuit card 3 and its rotary side supported on a rotating plate 10 of the rotating shaft 7 to derive through the rotating plate 10 an electric current from a power source connected to the printed circuit card 3.

The rotating shaft 7 has a rotating base 12 mounted thereon, on which a rotary arm 11 is mounted through a shaft 17 so that it will rotate together with the rotating base 12.

Hence, the rotary arm 11 rotates describing a conical surface whose axis is coaxial with the rotating shaft 7. By changing, through the shaft 17, the mounting angle of the rotary arm 11 with respect to the rotating base 12, the apex angle of the conical surface on which the rotary arm 11 rotates can be changed. That is, the rotary arm 11 can be made to turn along a conical surface with a desired apex angle, which may range from an almost flat apex angle to a sharp one.

The rotary arm 11 has an elongate opening 13 extending toward the center of the conical surface, in which a linear heater 14 made of heating wire is installed. The rotary arm 11 also contains a sirocco fan 16 driven by a motor 15. The heater 14 uses either a Nichrome wire or a infrared heater. In the case of the infrared heater, it is necessary to mount a reflection plate at the back.

The motor 15 and the heater 14 are connected to the rotary feeder 9 on the side of the rotating plate 10 and are supplied with electric current from the power source through a switch attached on the body cover 2. When the switch is turned on, they are rotated or heated.

Since the sirocco fan 16 is provided along the entire length of the heater 14, the air flow passing through the heater 14 is equal at any part of the heater 14 and the temperature of the air is also the same, so that the hair is uniformly heated by the blowing air.

When, with the head of a person positioned on an extension of the axis of the conical surface, the switch is turned on to energize the sirocco fan 16 and the heater 14, the blowing air from the sirocco fan 16 is heated by the heater 14 and the warm or hot air is blown uniformly from the opening 13.

The elongate opening 13 extends toward the center of the conical surface along which the rotary arm 11 rotates and, since the head of a person being treated is located on the extension of the axis of the cone, the hot air is blown toward the hair of the person. Further, since the mounting angle of the rotary arm 11 with respect to the rotating base 12 can be changed over the range of $\alpha$ as shown in FIG. 1, the conical surface of the rotating arm 11 can be varied in the range between a two-dot line and a one-dot line in the figure. This makes it possible to always keep the distance from the heater 14 and opening 13 to the hair constant even when treating such expanded hair as indicated by two-dot line.

Thus, the effect of the infrared rays and hot air on the entire hair is equalized, regardless of the difference in hair style, assuring uniform drying and treatment of hair. When the heater 14 is turned off, it is possible to blow cold air from the sirocco fan 16 to the hair.

Further, the rotary arm 11 may be rotated in forward and backward directions reciprocally. When the reciprocal rotation is used, the rotary feeder 9 may be omitted.

While in the above embodiment the sirocco fan 16 is installed in the rotary arm 11, it is possible to use a centrifugal fan instead, install it in the body cover 2, and introduce the blowing air into the rotary arm 11 through a pipe.

Figure 3:
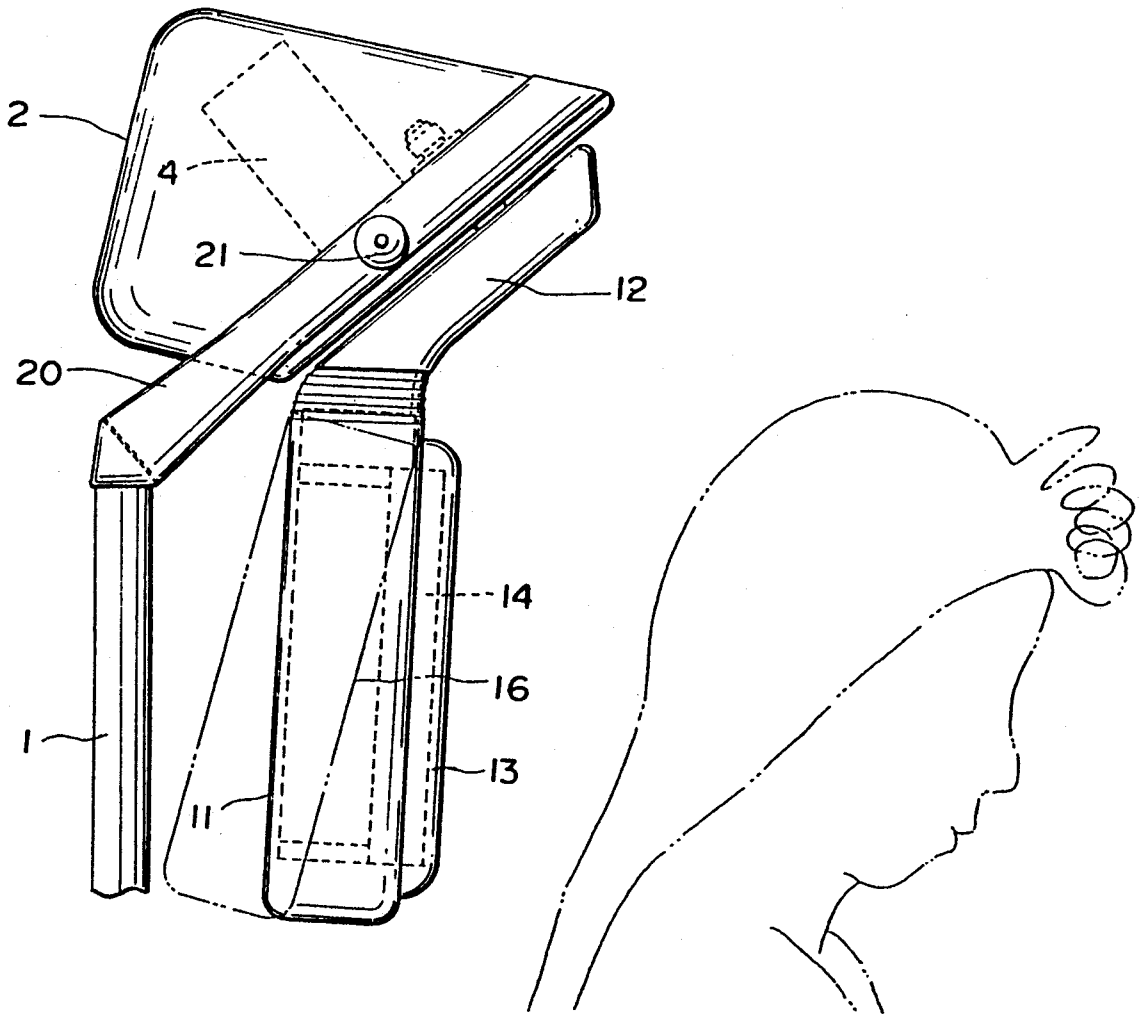
FIG. 3 is a side view of another embodiment of the invention, showing a rotary arm mounting angle changing means.
Figure 4:
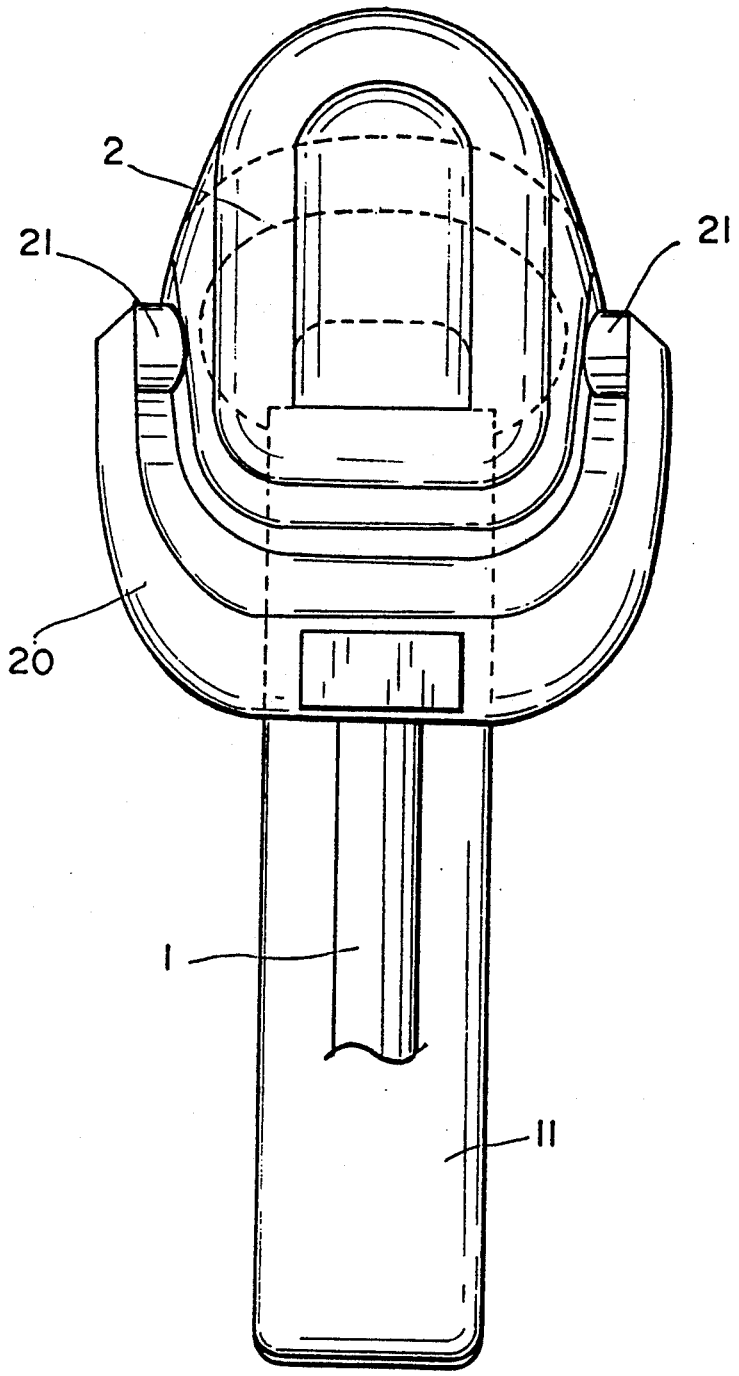
FIG. 4 is a rear view of FIG. 3.

Next, a second embodiment of the invention will be described by referring to FIGS. 3 and 4.

In this embodiment, at the top of the support rod 1 erected on the base on the floor is mounted a U-shaped support arm 20 whose ends are attached with a tiltable body cover 2, similar to the one in the first embodiment, through shafts 21. The body cover 2 contains a rotating means such as a motor to rotate the rotating base 12, on which a rotary arm 11 is tiltably mounted by a flexible connecting device 22.

The rotary arm 11 contains a sirocco fan 16, a heater 14 and a hot air blowing opening 13. In this embodiment, therefore, by changing the tilting angle of the body cover 2 on the shafts 21, the axis of the conical surface along which the rotary arm 11 is rotated can be inclined to any desired angle.

A person to be treated generally sits on a chair and the attitude of her head may change—tilted forward or backward or otherwise—depending on what she is doing, such as reading and napping. In the hair treatment apparatus like this embodiment in which the hot air blowing opening 13 turns along the conical surface, the center line of the head should preferably match the center of the conical surface along which the rotary arm 11 rotates. This requirement can be met by tilting the body cover 2 to align the extension of the center line of the head with the center of the conical surface. Since the rotary arm 11 rotates about the center line of the head, the distance from the hair to the rotary arm 11 can be made uniform, providing flexibility for a variety of attitudes of the person or different head angles.

Next, a third embodiment of the invention will be described by referring to FIGS. 5 to 8. Parts identical with those of the second embodiment are given like reference numerals and their explanations omitted.

Denoted 31 is a base that can be moved on casters 32. On the base is erected a support pipe 33, to the upper end of which is mounted a support rod 1 that can be slid vertically by loosening a handle 34 or fixed there by tightening it.

A motor 4 is mounted to a subframe 2*a* secured to the body cover 2 and its rotation is transmitted to a gear 36 through a gear 35. The gear 36 is loosely mounted on a slip disk 38 which is rigidly secured to the rotating shaft 7 rotatably supported through bearings 37 on the body cover 2 and the subframe 2*a*. A slip member 39 like felt is interposed between the slip disk 38 and the gear 36.

Interposed between the subframe 2*a* and the rotating shaft 7 is a push spring 40 that urges the rotating shaft 7 upward to press the slip disk 38 against the gear 36 through the slip member 39 so that the friction between them transmits the rotation of the gear 36 to the slip disk 38. However, when the rotation of the slip disk 38 is hindered for some reason, the slip member slips with the result that the rotation of the gear 36 is not transmitted to the slip disk 38.

As in the previous embodiments, the rotary feeder 9 has its fixed side mounted to the body cover 2 and its rotary side mounted to the rotating shaft 7 to derive from the rotary side an electric current of the power source connected to the body cover 2.

Figure 9:
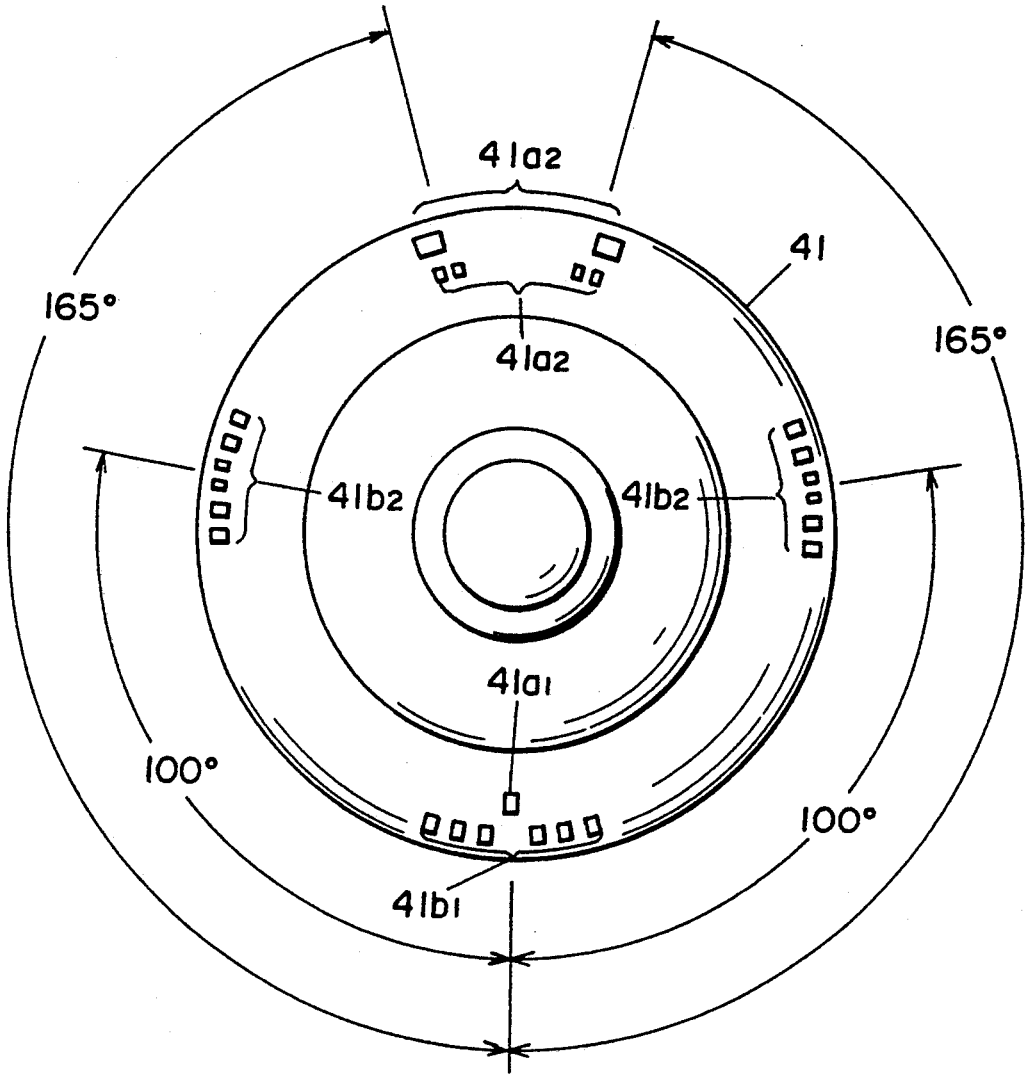
FIG. 9 is a plan view of a disk for detecting the position of the rotating arm.

The slip disk 38 is attached with a disk 41 for detecting the rotary position. The disk 41 is formed with inner circumferential slits 41*a* and outer circumferential slits 41*b* as shown in FIG. 9. A photosensor 42 is provided to the body cover 2 on each side of the disk 41 to detect the slits 41*a*, 41*b*. According to the output from the photosensor 42, the rotary position of the rotary arm 11—that moves together with the rotating shaft 7—can be determined.

Figure 5:
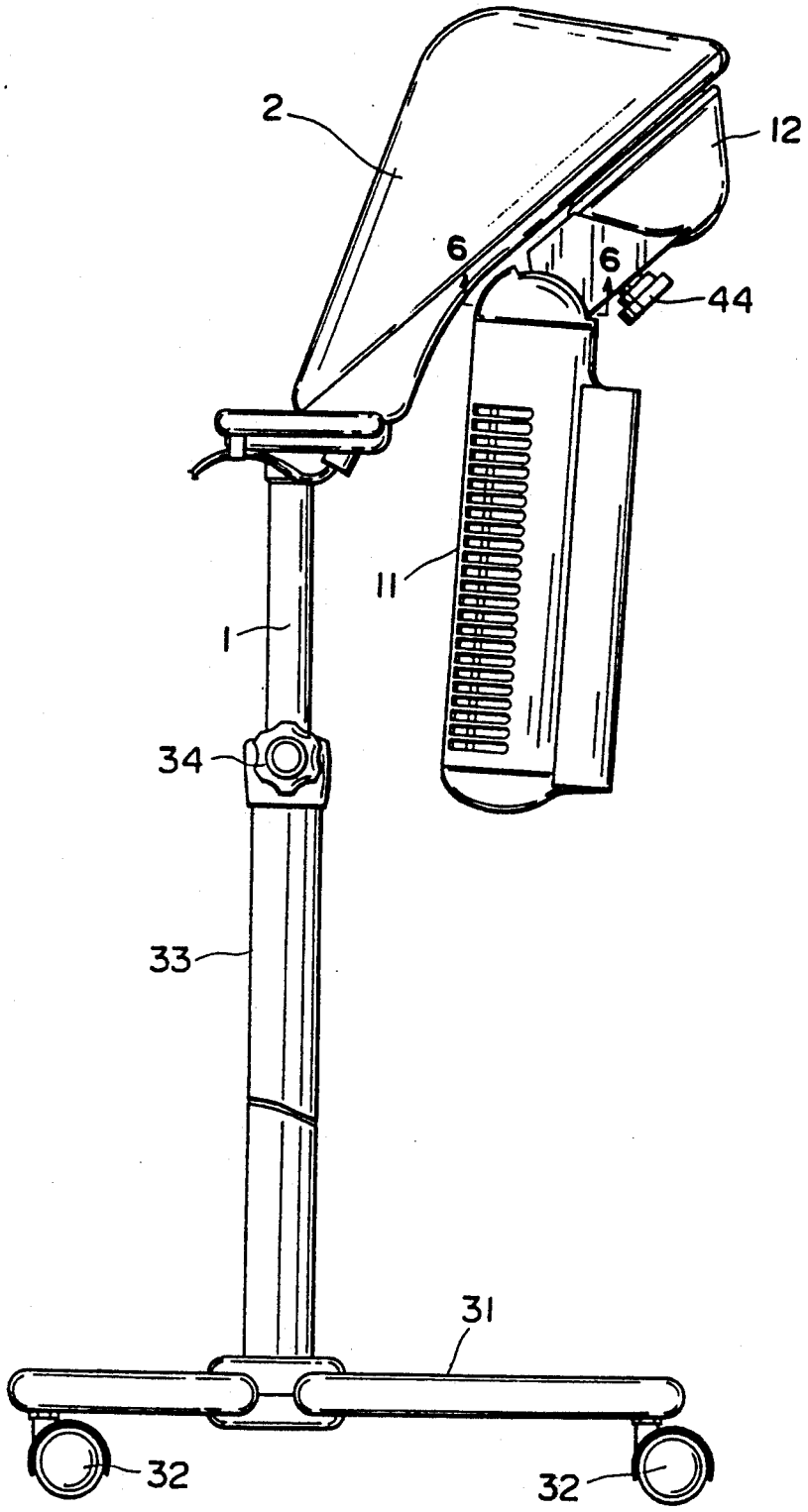
FIG. 5 is an overall side view of still another embodiment of the invention, showing a rotary arm mounting angle changing means.
Figure 6:
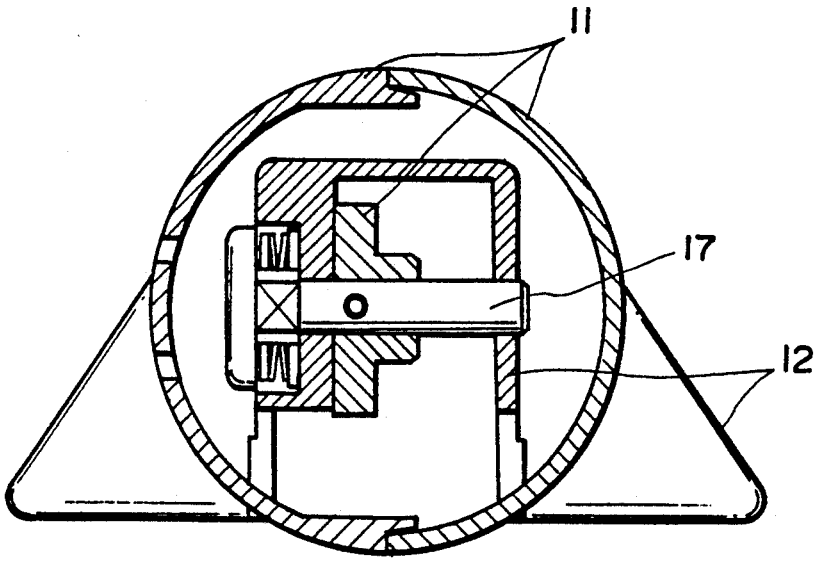
FIG. 6 is a cross section of a body cover along the lines 6—6 of FIG. 5.
Figure 7:
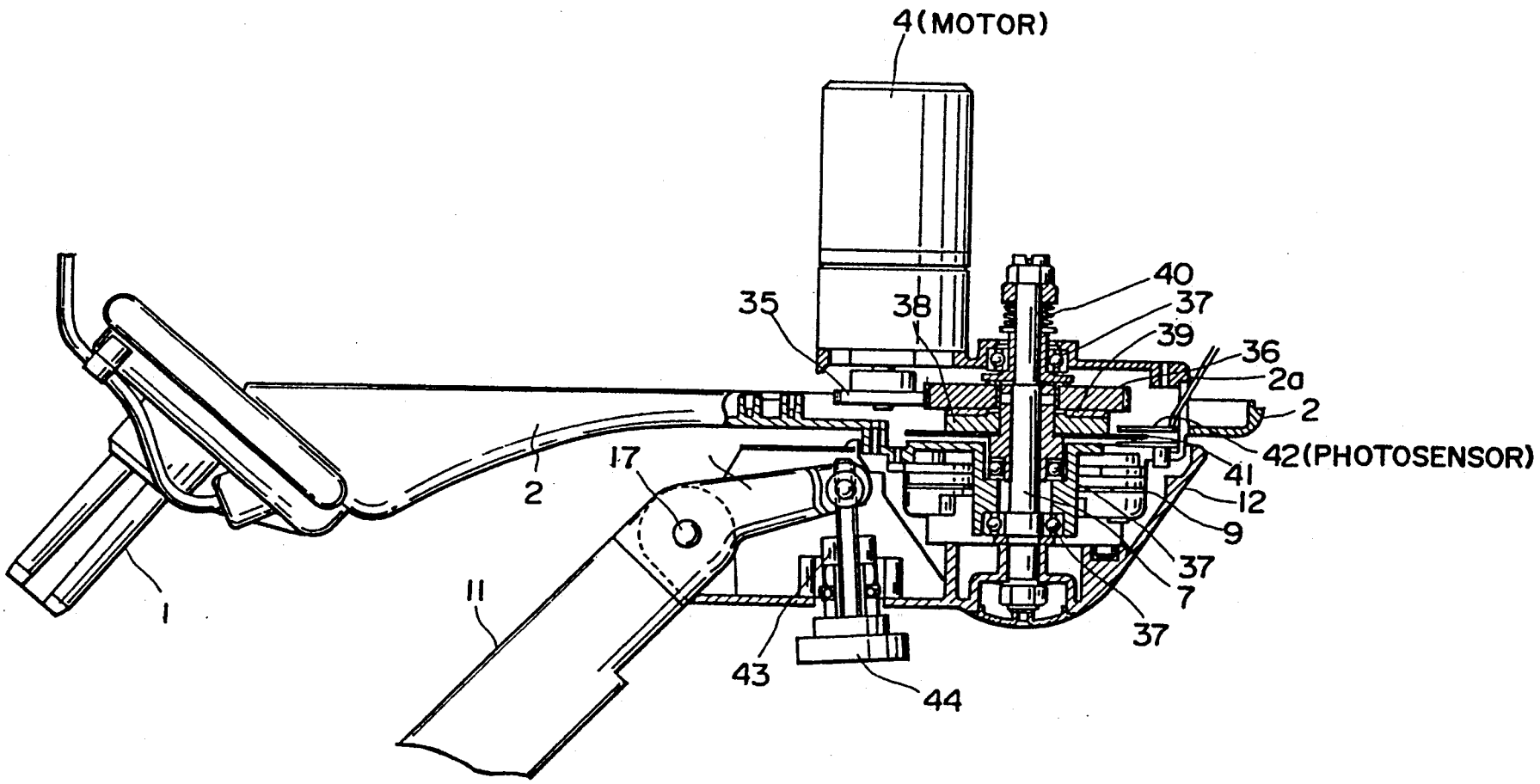
FIG. 7 is a partial cross section of the apparatus of FIG. 5, showing the body cover and the rotating portion of the rotating arm in section.
Figure 8:
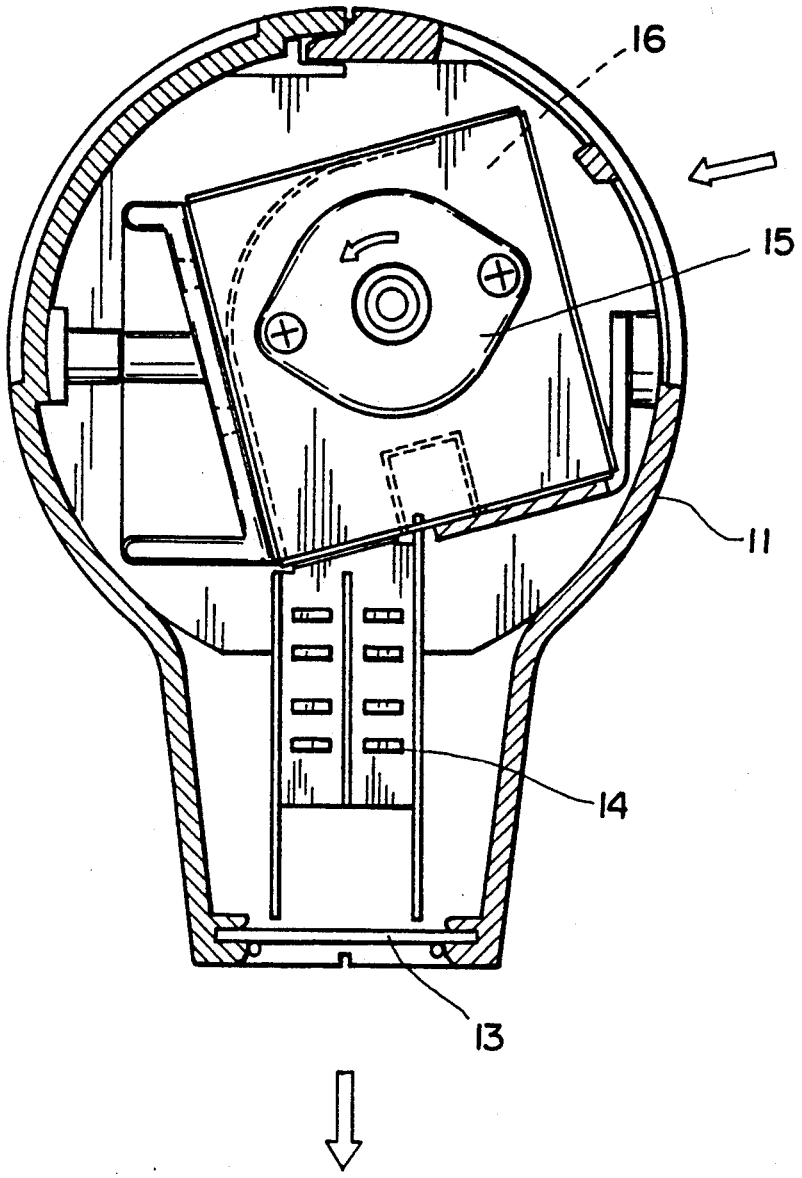
FIG. 8 is a cross section of the rotating arm.

To explain in more detail, the slits 41*a*, 41*b* formed in the disk 41 have reference slits $41a_1$, $41b_1$ to detect a reference position of the rotary arm 11, a position in which the rotary arm 11 is vertical to the floor (see FIG. 5). They also have reverse slits $41a_2$ at positions 165 degrees to the left and right of the reference slit $41a_1$ and another reverse slits $41b_2$ at positions about 100 degrees to the left and right of the reference slit $41b_1$.

Using the position detecting means of the above construction in the rotary arm 11, a rotating angle setting switch for the rotary arm 11 (not shown) is manipulated to set the reciprocating angle to 330 degrees. Since in the initial condition the photosensor 42 has detected the reference slit $41a_1$ of the inner circumferential slit 41*a*, the motor 4 is started from this position to turn the rotary arm 11 to either the left or right.

As the rotary arm 11 turns and the photosensor 42 detects a reverse slit $41a_2$, the motor 4 is reversed to rotate the rotary arm 11 in the opposite direction until the other reverse slit $41a_2$ is detected by the photosensor 42. The rotary arm 11 performs reciprocal opposite rotations in the range of 330 degrees. During this reciprocal rotation, when the timer's setting time is up or the stop switch is operated, the motor 4, no matter where the rotary arm 11 is at this time, continues to be supplied with current until the photosensor 42 detects the reference slit $41a_1$. When the photosensor 42 detects the reference slit $41a_1$, it cuts off power to the motor 4 to halt the rotary arm 11 at the vertical position.

Consider a case where the rotating angle of the rotary arm 11 is set to 200 degrees. Since the photosensor 42 has detected the outer circumferential slit $41b_1$, the motor 4 is rotated to either left or right from this reference position until the photosensor 42 detects a reverse slit $41b_2$. When the photosensor 42 detects the reverse slit $41b_2$, it reverses the motor 4 to rotate the rotary arm 11 in the opposite direction until it detects the other reverse slit $41b_2$. In this way, the rotary arm 11 is reciprocated in the range of 200 degrees. When, during the reciprocating rotary operation, the timer's setting time is up or the stop switch is operated, the rotary arm 11 continues to operate until it reaches the vertical position, at which time the motor 4 is stopped.

The reason that multiple slits are provided for the reference slit $41b_1$ and reverse slit $41b_2$ of the outer circumferential slits 41*b* is to prevent a failure of detection that might occur for some reason when only one slit is used, thereby assuring a reliable reversing and stopping operation of the rotary arm 11. Another reason for the provision of multiple slits is to offer an assistance in assuring the correct reading of the inner circumferential slit 41*a* by also reading the outer circumferential slit 41*b*.

The rotary arm 11—which is tiltably supported through the shaft 17 on the rotating base 12 that in turn is secured to the rotating shaft 7—has its base-side arm 11*a* securely connected with the front end of a handle screw 44 that screws into a support member 43 tiltably supported on the rotating base 12. As the handle screw 44 is turned, the rotary arm 11 is tilted about the shaft 17, thus changing the apex angle of the conical surface described by the rotary arm 11 as it rotates. The rotary arm 11 accommodates, as in the preceding embodiments, the opening 13, heater 14 and sirocco fan 16 driven by the motor 16.

With this embodiment, when the rotary arm 11 driven by the motor 4 comes into contact with the shoulder or any other part of a person being treated or the arm or body of an operator, the slip member 39 slips to cut off the power transmission between the slip disk 38 and the gear 36, preventing the rotary arm 11 from rotating any further.

Therefore, this embodiment ensures that the rotary arm 11 stops as soon as it hits a part of the body of the person being treated or of the operator, protecting them from any excess pressure and also preventing the hair treatment apparatus from falling. In other respects, this embodiment has similar effects to those of the preceding embodiments.

While in the preceding embodiments the rotary arm 11 is shown to rotate continuously in one direction, it is also possible to have the rotary arm 11 rotate reciprocally in opposite directions. In this case, the rotary feeder 9 may be replaced with lead wires, which in turn reduces the cost.

Figure 10:
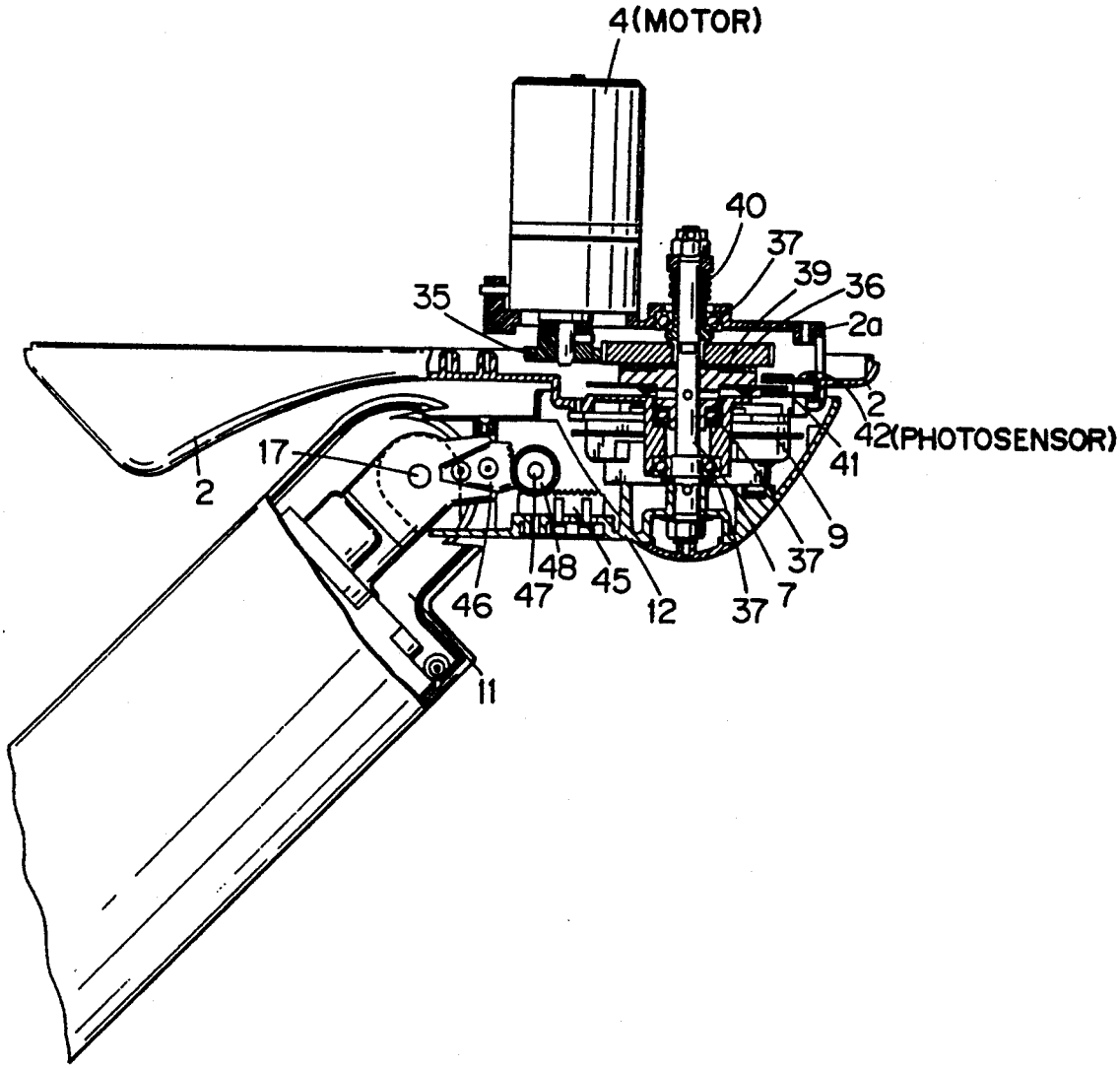
FIG. 10 is a side view of another embodiment of a mounting angle changing means.
Figure 11:
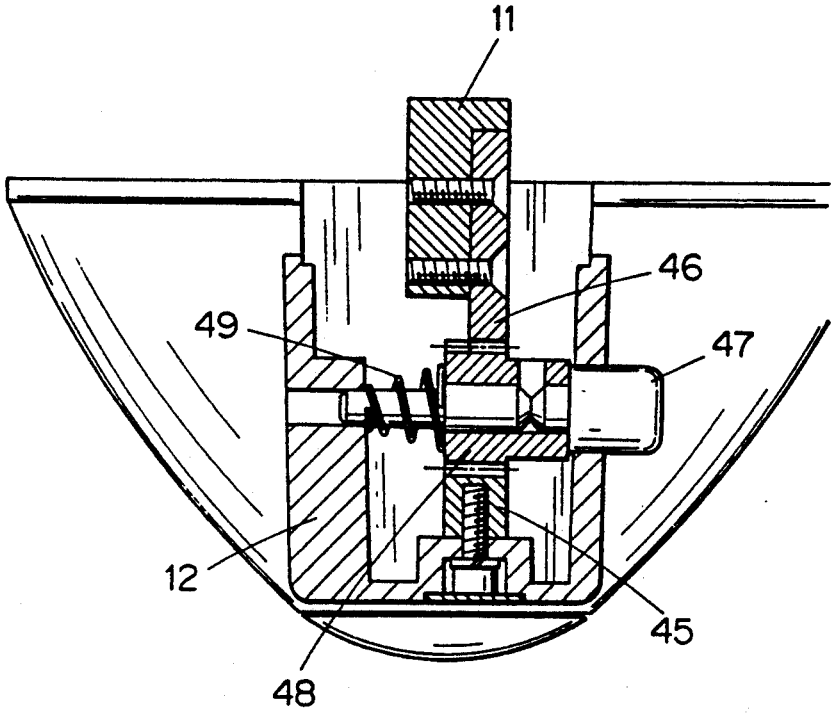
FIG. 11 is a cross section of FIG. 10.

Next, by referring to FIGS. 10 and 11, we will explain about another embodiment of the mounting angle changing means to change the apex angle of the conical surface described by the rotation of the rotary arm 11. Denoted 45 is a rack secured to the rotating base 12; 46 a fan-shaped gear projecting from the base portion of the rotary arm 11; and 47 an operation rod which is rotatably supported on the rotating base 12 in such a way as to be axially slidable. The operation rod 47 is rigidly fitted with a gear 48 that can be brought into and out of engagement with the rack 45 and the fan-shaped gear 46. The operation rod 47 is urged by a spring 49 to maintain the engagement with the gears.

In this embodiment, when one wants to adjust the angle of the rotary arm 11 with respect to the rotating base 12, one pushes the operation rod 47 against the force of the spring 49 to release the gear 48 from engagement with the rack 45 and the fan-shaped gear 46. Then, the operator tilts the rotary arm 11 about the shaft 17, after which he or she releases the pushing force, allowing the operation rod 47 to return to its original position by the force of the spring 49, so that the gear 48 comes into mesh with the rack 45 and the fan-shaped gear 46 to lock the rotary arm 11 to the rotating base 12.

The advantages of this invention may be summarized as follows.

The rotary arm, while being rotated describing a conical surface, blows hot air toward the axis of the conical surface, so that the hot air is blown over a wide area of the head of a person from all sides, ranging from the top of the forehead to the lower part of the rear head. Since the hot air does not concentrate on one portion, the person being treated will not feel excessive heat. Further, since the space surrounding the head is open, it is easy to touch and check the drying condition of the hair being dressed and give a correcting touch to the hair style whenever one wants to.

The rotary arm can be changed in its mounting angle by the mounting angle changing means to widen or narrow the apex angle of the conical surface along which the rotary arm is rotated. It is therefore possible to blow hot air over a wide or narrow area depending on the expanse of the hair. Moreover, since the mounting angle changing means is made up of the rack, the fan-shaped gear and the pinion gear, and since the pinion gear can be brought into and out of engagement with the rack and the fan-shaped gear, the mounting angle of the rotary arm can be changed and held to any desired angle with ease.

A further advantage is that by tilting the rotating means for the rotary arm by a tilting means, the center of the conical surface along which the rotary arm rotates can be aligned with the center axis of the head, so that the hot air can be blown from any desired angle according to the attitude or angle of the head. Therefore, the hot-air blowing to the hair can be done uniformly for different hair styles and head angles or attitudes, making it possible to perform drying and treatment of hair uniformly in a short period of time.

Moreover, when during its rotation the rotary arm comes into contact with a part of the body of the person being treated or of the operator or strikes an object, the slip means slips to stop the rotation of the rotary arm. This prevents excessive pressure from being applied to the contact portion of the body, thereby protecting them from possible injuries or uncomfortableness. It also prevents the hair treatment apparatus from falling when it strikes an object, thus protecting the apparatus from damages.

Another advantage is that since the rotary arm is reciprocally rotated in opposite directions, the lead wires are prevented from getting twisted. When the timer's setting time has come or the stop operation is done, the rotary arm is made to stop at the predetermined reference position, so that the rotary arm will not pose any obstacle to a person who is going to sit on the chair for treatment.

What is claimed is:

1. A hair treatment apparatus comprising a body cover;

support means for supporting said body cover such that said body cover faces obliquely downward;

rotating means rotatably attached to said body cover at an underside thereof;

a rotary arm attached at a tilted angle to said rotating means and adapted to rotate in a path defining a conical surface about said body cover, said rotary arm having an air blowing passage with an air discharge opening (13) in said arm;

air blowing means in said rotary arm for blowing air toward said discharge opening;

a heater installed in said air blowing passage between the air blowing means and the discharge opening; and drive means provided in said body cover to rotate said rotating means such that said rotary arm rotates in said path defining the conical surface about said body cover.

2. A hair treatment apparatus according to claim 1, further including means for changing the tilted angle at which said rotary arm is attached to the rotating means such that an apex angle of said conical surface described by the rotary arm during rotation thereof is changed.

3. A hair treatment apparatus according to claim 2, wherein said means for changing the tilted angle at which said rotary arm is attached to the rotating means includes a rack gear secured to the rotating means; a fan-shaped gear secured to the rotary arm; and a pinion gear rotatably supported on the rotating means in such a way that the pinion gear is axially slidable to be brought into or out of engagement with the rack gear and the fan-shaped gear.

4. A hair treatment apparatus according to claim 1, further including slip means provided in the rotating means to slip when the rotation of the rotary arm is blocked by an external force, allowing the drive means to operate unloaded.

5. A hair treatment apparatus according to claim 1, further including arm position detecting means installed in the rotating means and having a disk and a photo sensor to detect a reference position and a rotation limit position of the rotary arm.

* * * * *